US010837290B2

(12) United States Patent
Lee et al.

(10) Patent No.: US 10,837,290 B2
(45) Date of Patent: Nov. 17, 2020

(54) STRUCTURE FOR COOLING ROTOR OF TURBOMACHINE, ROTOR AND TURBOMACHINE HAVING THE SAME

(71) Applicant: DOOSAN HEAVY INDUSTRIES & CONSTRUCTION CO., LTD, Changwon-si (KR)

(72) Inventors: Jong Wook Lee, Gyeongsangnam-do (KR); Han Ul Kim, Gyeongsangnam-do (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 176 days.

(21) Appl. No.: 15/694,280

(22) Filed: Sep. 1, 2017

(65) Prior Publication Data

US 2018/0128114 A1 May 10, 2018

(30) Foreign Application Priority Data

Nov. 10, 2016 (KR) ..... 10-2016-0149714

(51) Int. Cl.
*F01D 5/18* (2006.01)
*F01D 5/08* (2006.01)
(Continued)

(52) U.S. Cl.
CPC ..... *F01D 5/187* (2013.01); *F01D 5/081* (2013.01); *F01D 5/085* (2013.01); *F01D 5/3007* (2013.01);
(Continued)

(58) Field of Classification Search
CPC ..... F05D 2260/16; F01D 25/12; F01D 5/187; F01D 5/084; F01D 5/082; F01D 5/081;
(Continued)

(56) References Cited

U.S. PATENT DOCUMENTS 2,656,147 A * 10/1953 Denison ..... F01D 5/084 416/97 R
3,572,966 A 3/1971 Borden
(Continued)

FOREIGN PATENT DOCUMENTS

EP 2208859 A2 7/2010
EP 2947268 A1 * 11/2015
(Continued)

OTHER PUBLICATIONS

A Japanese Office Action dated Aug. 14, 2018 in connection with Japanese Patent Application No. 2017-15979 which corresponds to the above-referenced U.S. application.

*Primary Examiner* — Courtney D Heinle
*Assistant Examiner* — Andrew Thanh Bui
(74) *Attorney, Agent, or Firm* — Invenstone Patent, LLC

(57) ABSTRACT

The present invention relates to a structure for cooling a turbomachine's rotor part and a rotor and a turbomachine having the same. The structure for cooling a turbomachine's rotor part includes: a dovetail joint part disposed along an outer circumferential surface of a rotor wheel and having a plurality of mounting grooves in which dovetails of buckets are mounted and cooling slots disposed along the outer circumferential surface of the rotor wheel on the dovetail joint part and having a cooling fluid flowing therethrough.

9 Claims, 18 Drawing Sheets

(51) Int. Cl.
*F01D 5/30* (2006.01)
*F01D 9/04* (2006.01)
*F01D 25/24* (2006.01)

(52) U.S. Cl.
CPC ..... *F01D 5/3015* (2013.01); *F01D 9/041* (2013.01); *F01D 25/24* (2013.01); *F05D 2220/30* (2013.01); *F05D 2240/81* (2013.01); *F05D 2250/70* (2013.01); *F05D 2260/221* (2013.01)

(58) Field of Classification Search
CPC ..... F01D 5/085; F01D 5/3007; F01D 5/3015; F01D 9/041; F01D 25/24
See application file for complete search history.

(56) References Cited

U.S. PATENT DOCUMENTS 3,728,042 A * 4/1973 Hugoson ..... F01D 5/081 416/95
7,207,776 B2 * 4/2007 Townes ..... F01D 5/081 416/193 A
9,631,495 B2 * 4/2017 Da Costa ..... F01D 5/081
2012/0134845 A1 5/2012 Khanin
2014/0294597 A1 10/2014 Da Costa et al.
2015/0118045 A1 * 4/2015 Giametta ..... F01D 5/18 416/1
2016/0376892 A1 * 12/2016 Snyder ..... F04D 19/002 416/1

FOREIGN PATENT DOCUMENTS

EP 2947268 A1 11/2015
JP 1973025686 A 7/1973
JP 10-246102 A 9/1998
JP 2007056874 A 3/2008
JP 2013148060 A 8/2013
JP 2015-092076 A 5/2015
NL 6919076 A 7/1970

* cited by examiner

[FIG. 1]
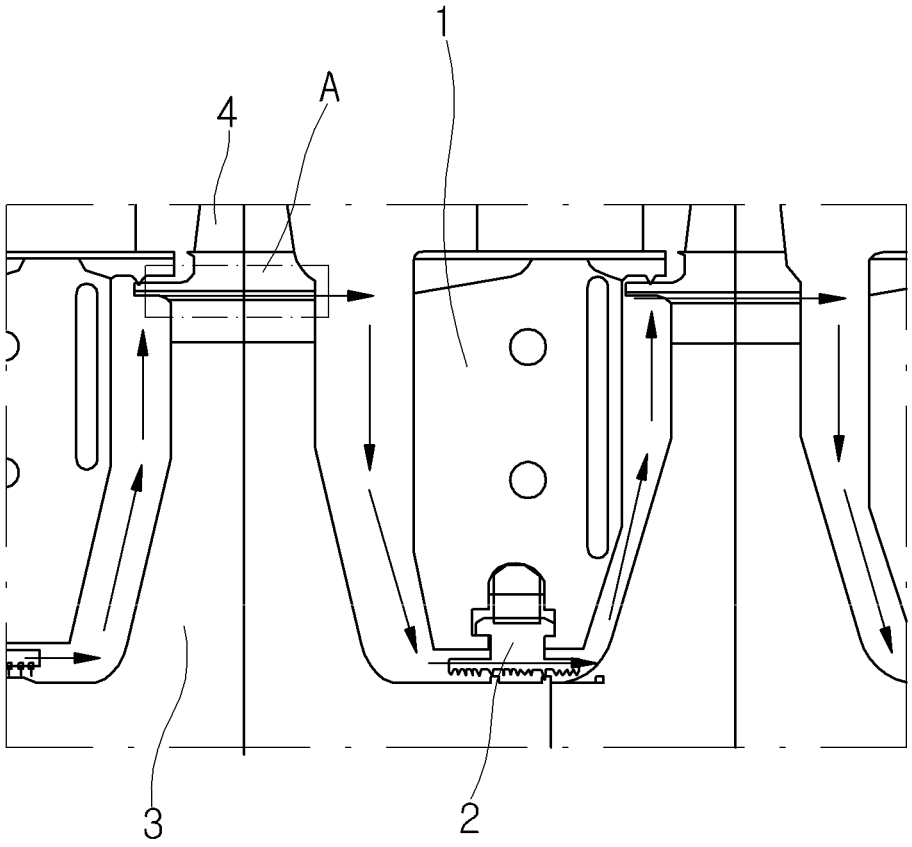

[FIG. 2]
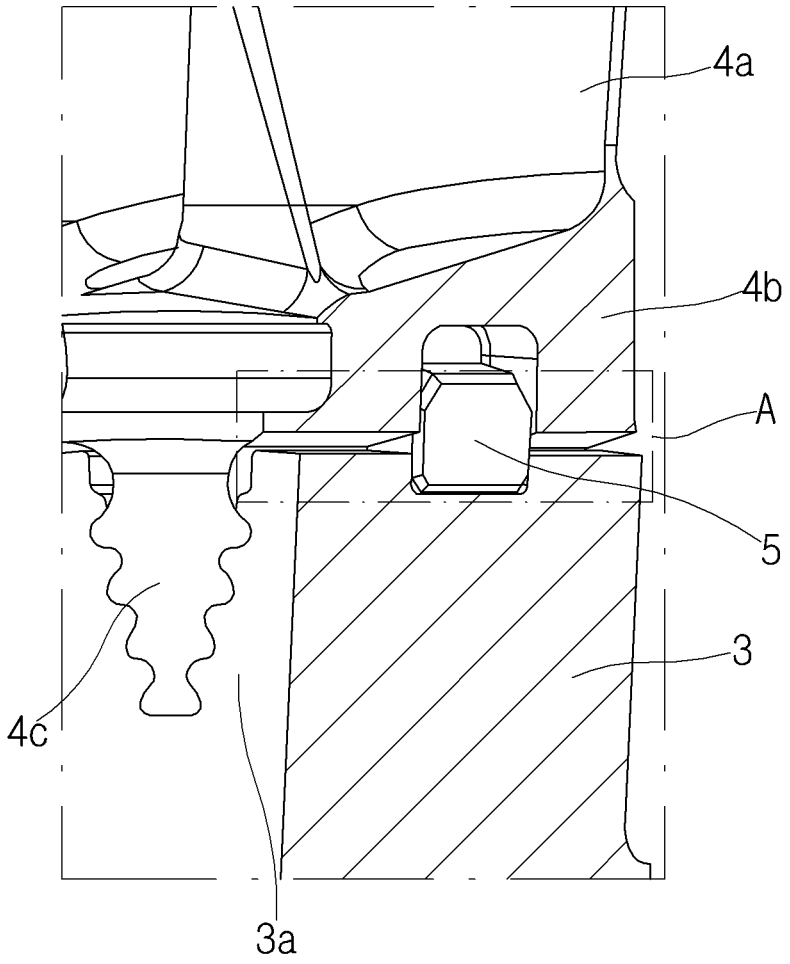

[FIG. 3]
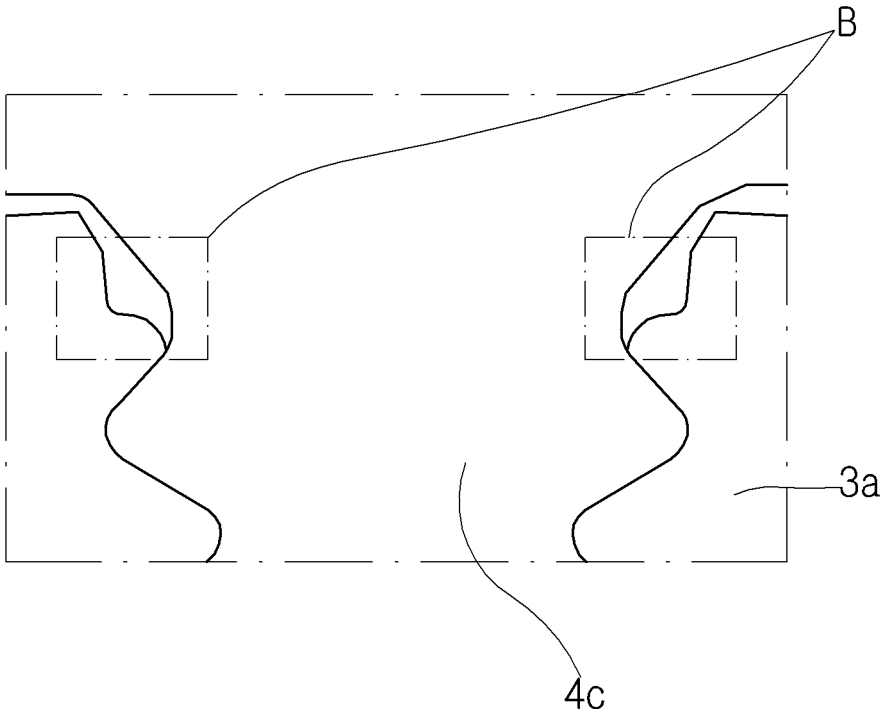

[FIG. 4]
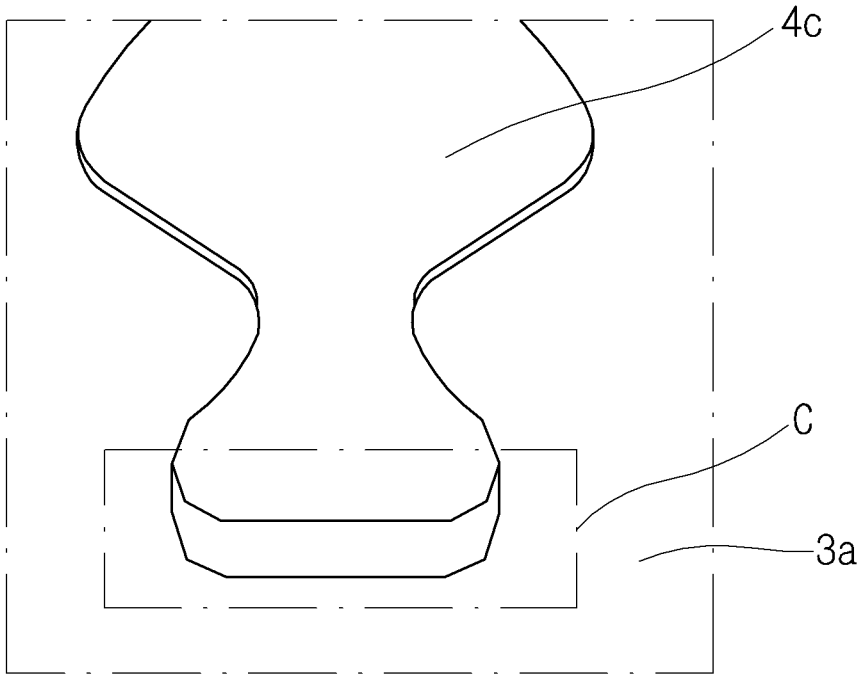

[FIG. 5]
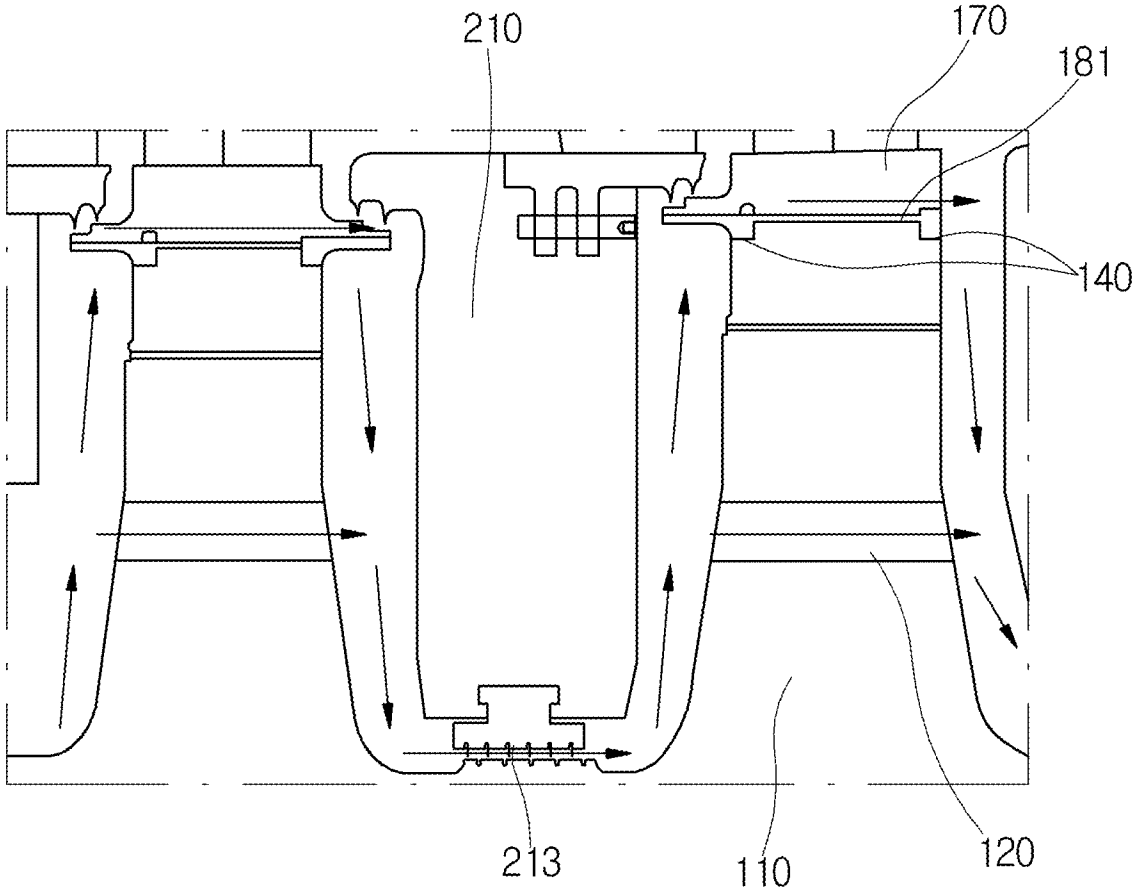

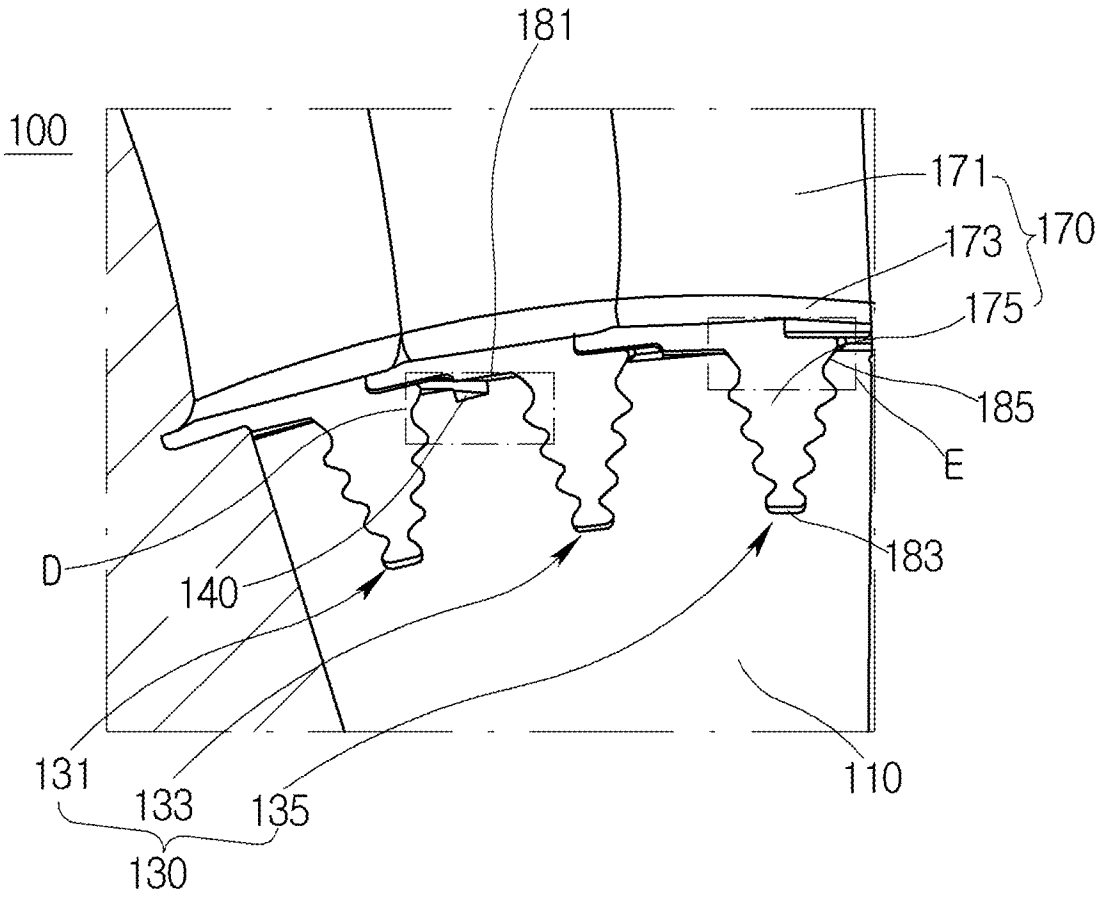
[FIG. 6]

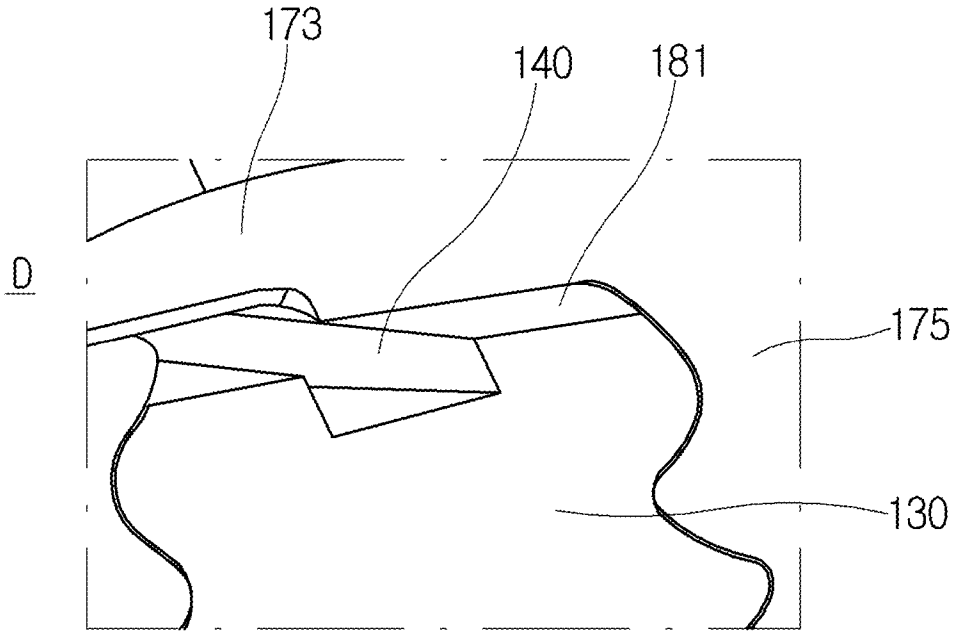
[FIG. 7]

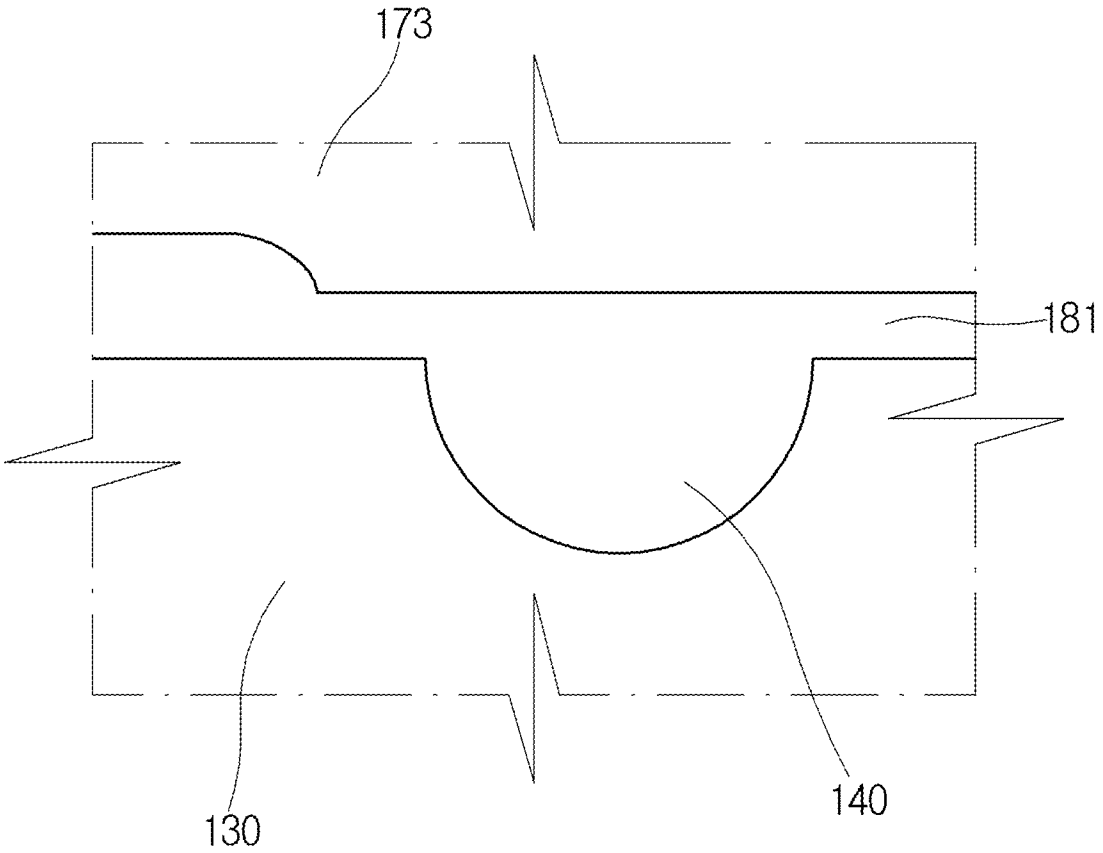
[FIG. 8]

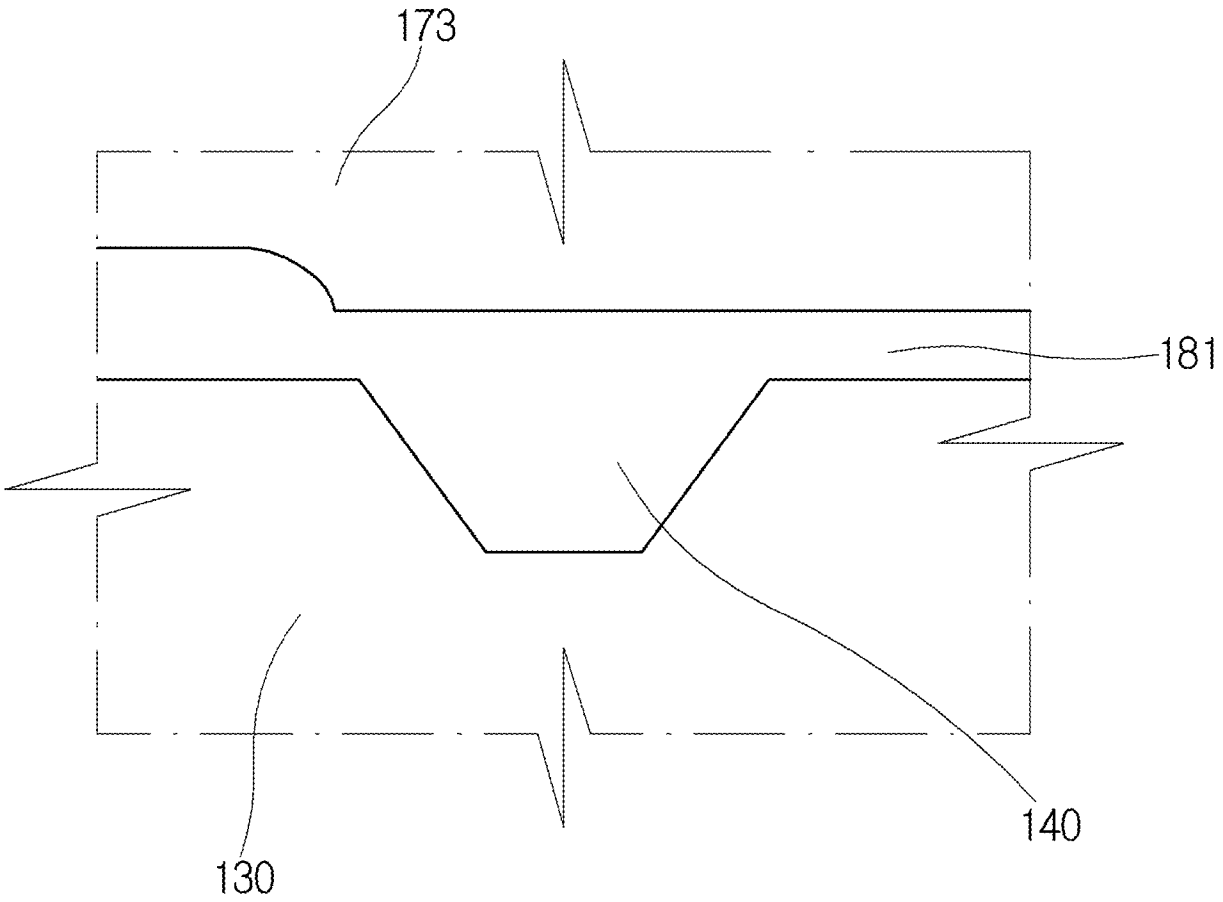
[FIG. 9]

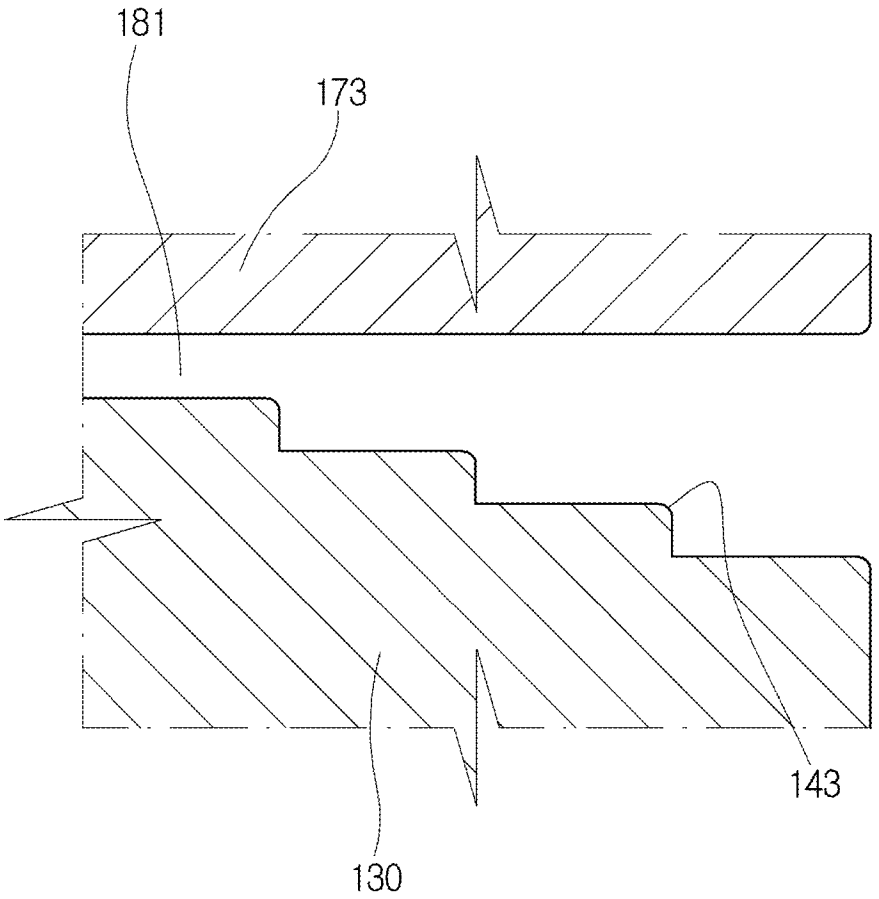
[FIG. 10]

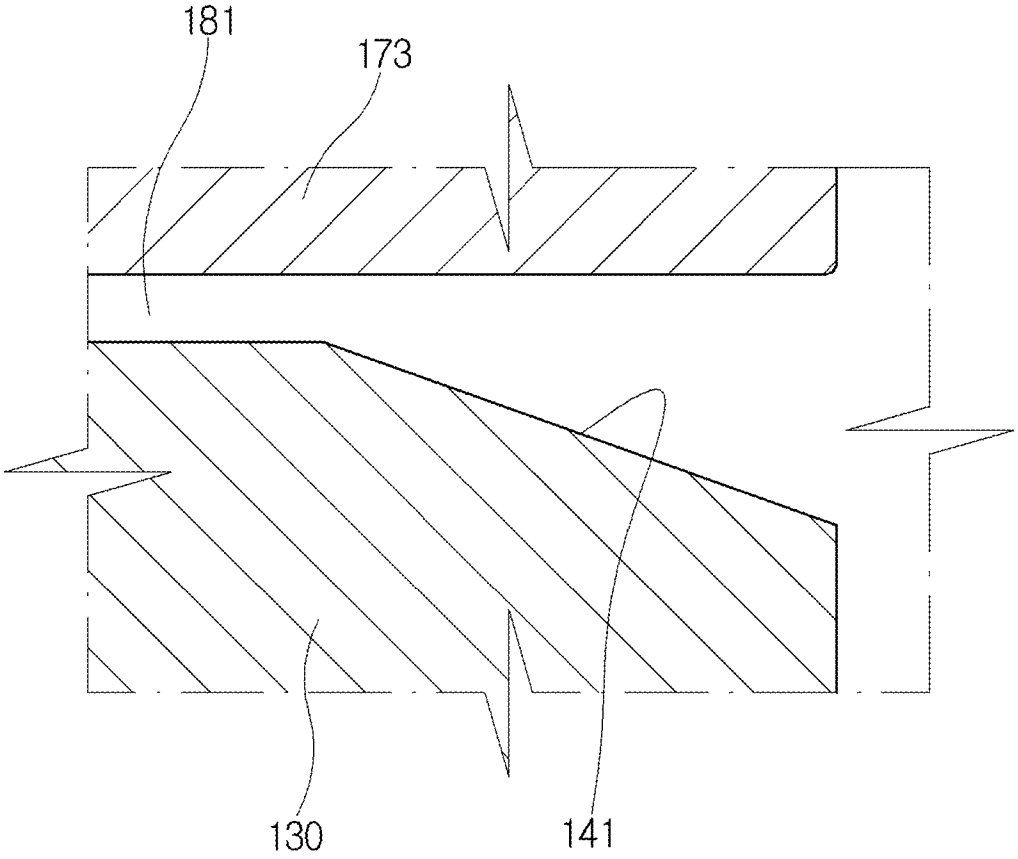
[FIG. 11]

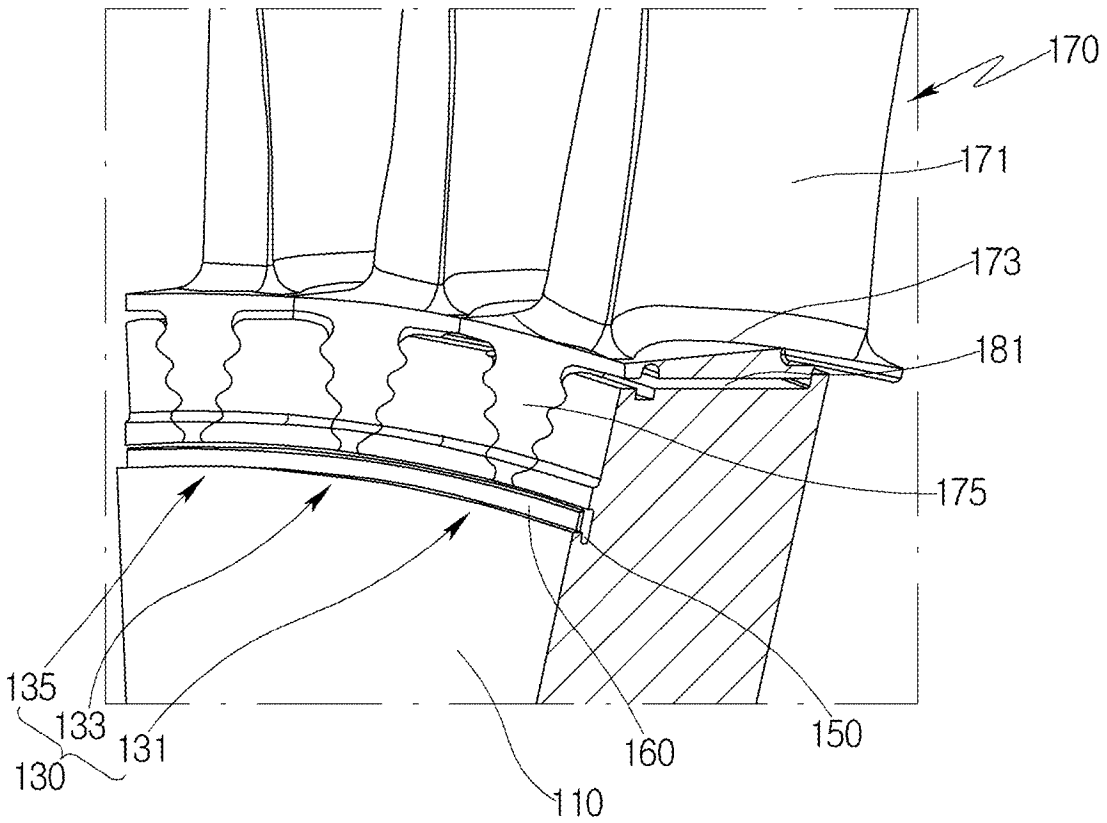
[FIG. 12]

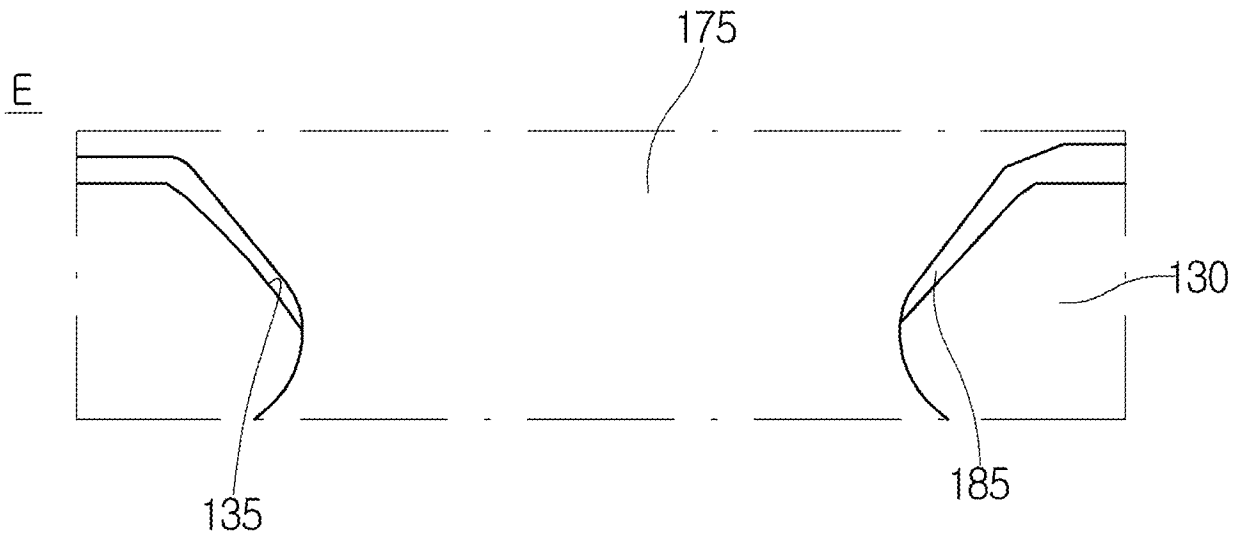
[FIG. 13]

[FIG. 14]
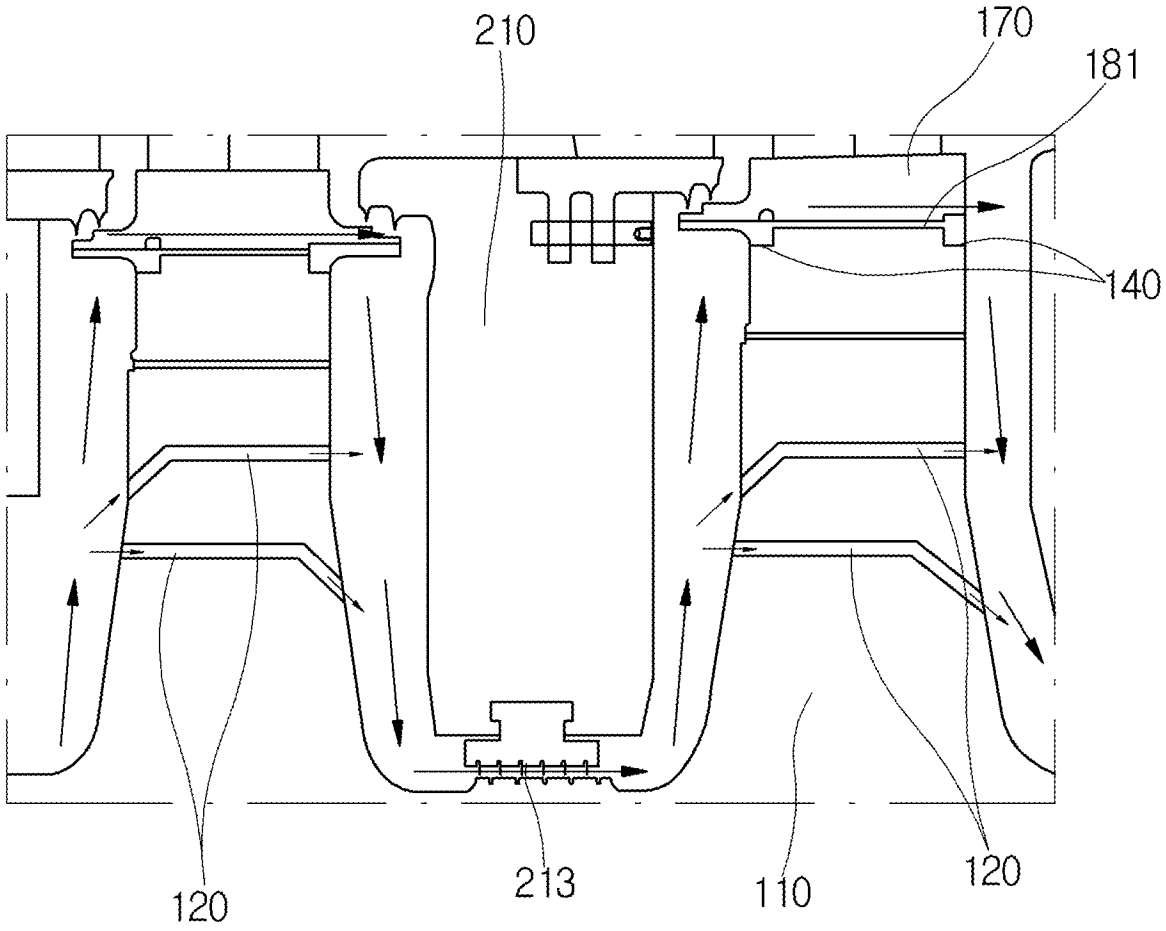

[FIG. 15]
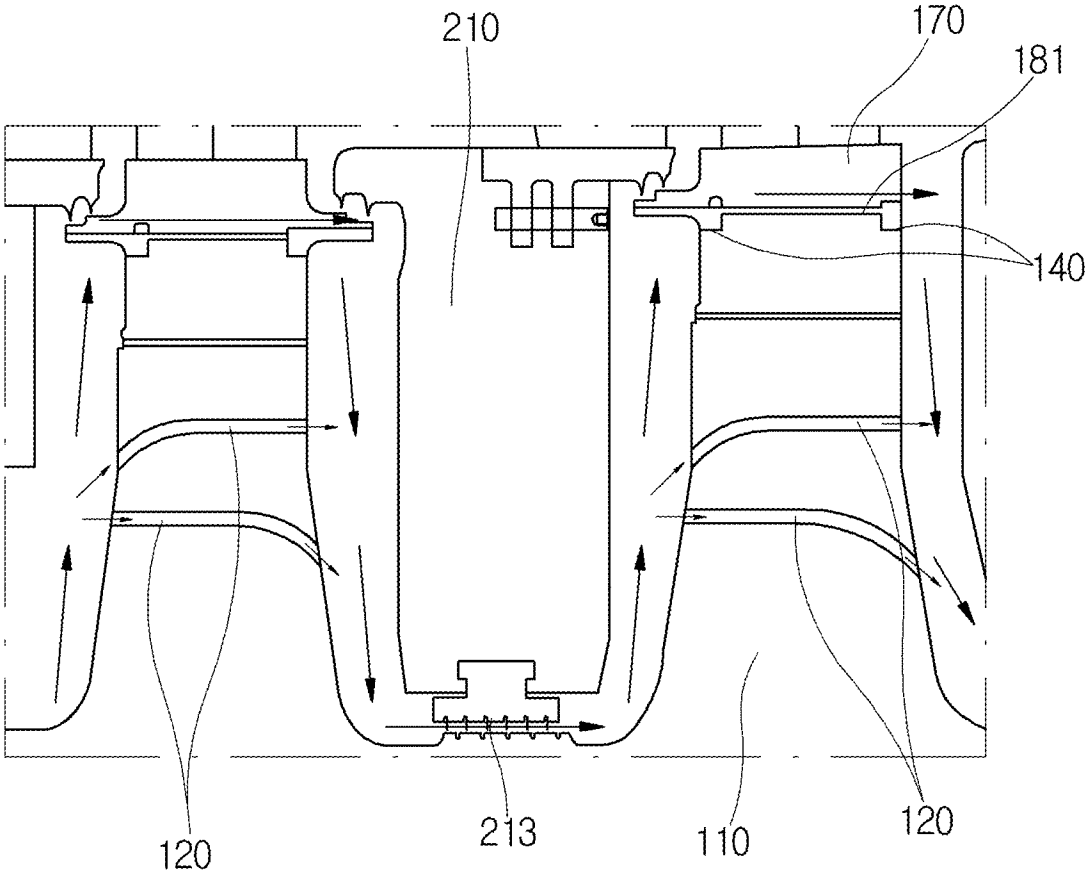

[FIG. 16]
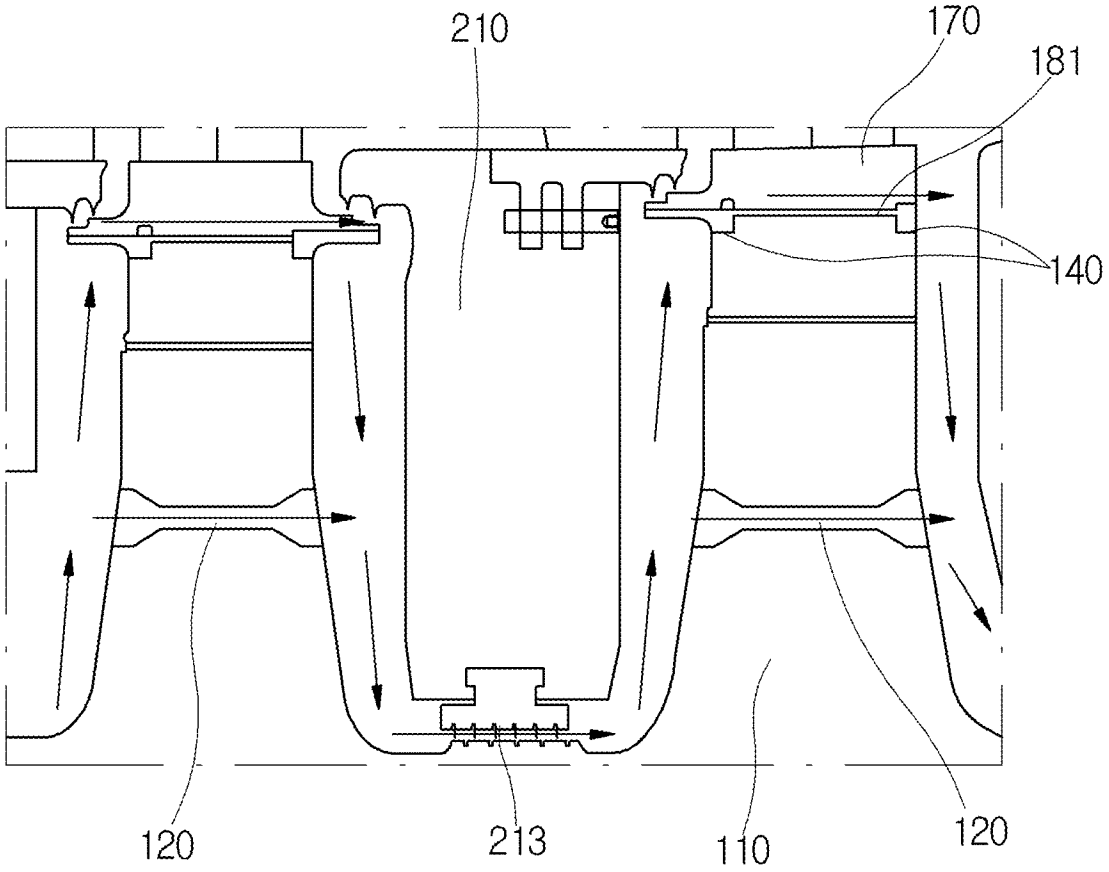

[FIG. 17]
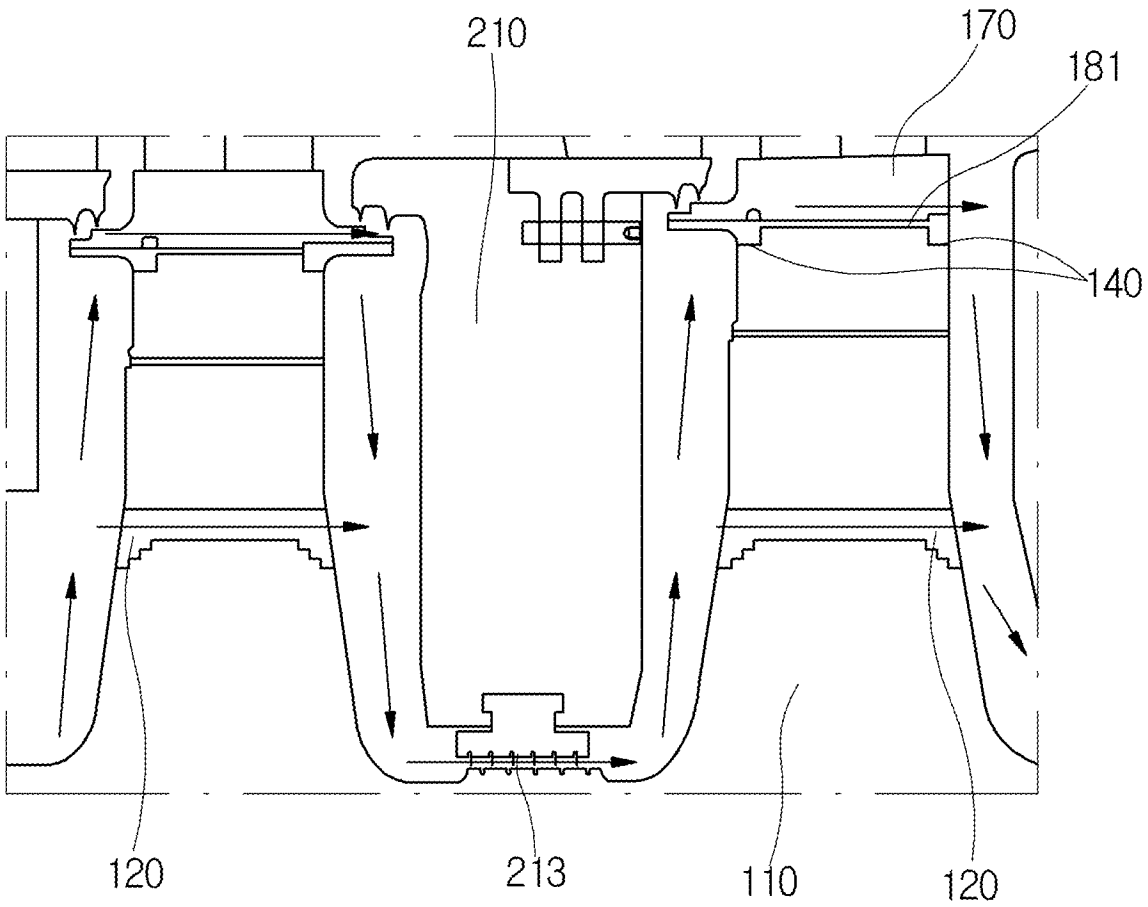

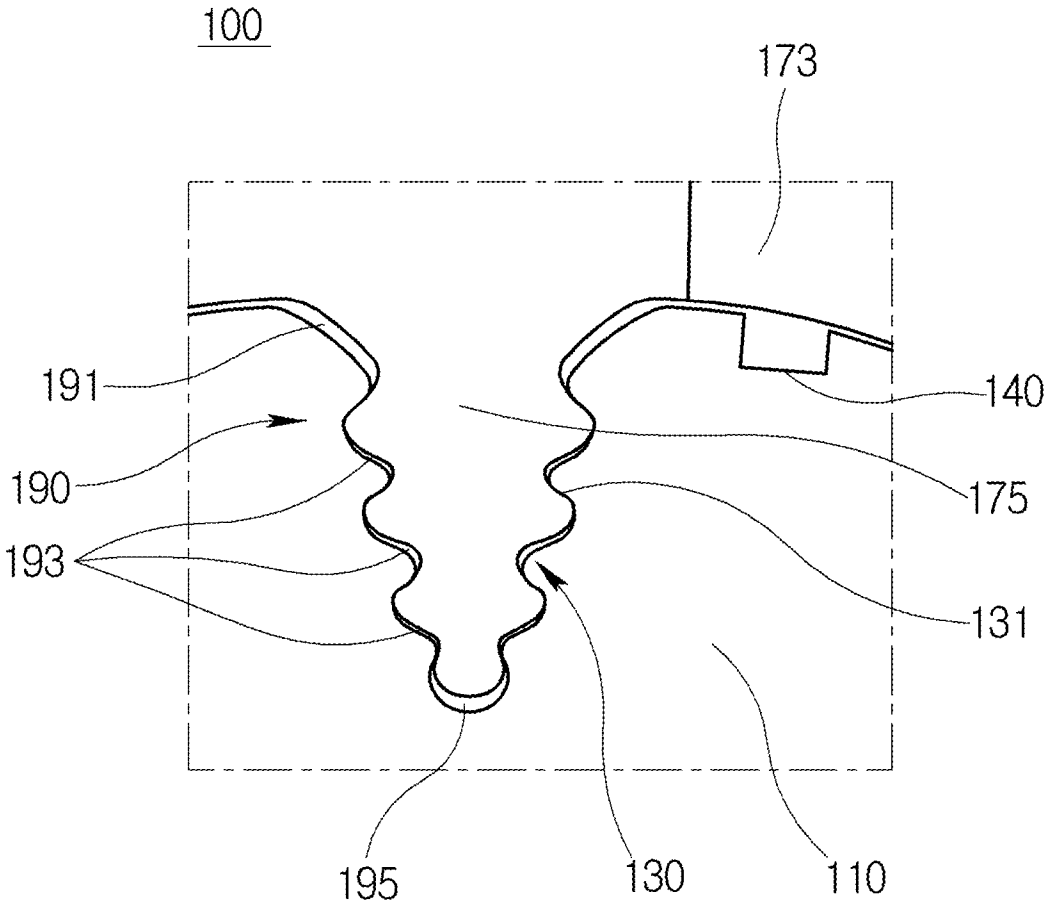
[FIG. 18]

STRUCTURE FOR COOLING ROTOR OF TURBOMACHINE, ROTOR AND TURBOMACHINE HAVING THE SAME

CROSS-REFERENCE TO RELATED APPLICATION

This application claims priority to Korean Patent Application No. 10-2016-0149714, filed on Nov. 10, 2016, the disclosure of which is incorporated herein by reference in its entirety.

BACKGROUND

Exemplary embodiments of the present disclosure relate to a structure for cooling a rotor of a turbomachine's and a rotor and a turbomachine having the same, and more particularly, to a structure for cooling a bucket and a rotor wheel of a turbomachine.

In general, a turbomachine is a power generating device converting heat energy of fluids, such as gas and steam, into a rotational force which is mechanical energy, and includes a rotor that includes a plurality of buckets so as to be axially rotated by the fluids and a casing that is installed to surround the rotor and includes a plurality of diaphragms.

A gas turbine includes a compressor section, a combustor, and a turbine section. Outside air is sucked and compressed by a rotation of the compressor section and then is sent to the combustor. The compressed air and fuel is mixed with each other in the combustor to be combusted. High-temperature and high-pressure gas generated from the combustor rotates the rotor of the turbine while passing through the turbine section to drive a generator.

In the case of the steam turbine, a high-pressure turbine section, an intermediate-pressure turbine section, and a low-pressure turbine section are connected to each other in series or in parallel to rotate the rotor. In the case of the serial structure, the high-pressure turbine section, the intermediate-pressure turbine section, and the low-pressure turbine section share one rotor.

In the steam turbine, each of the turbines includes diaphragms and buckets based on the rotor in the casing, and steam rotates the rotor while passing through the diaphragms and the buckets, thereby driving the generator.

FIG. 1 illustrates a flow of a cooling fluid inside the turbine. The cooling fluid flows through a gap between the rotor and a brush seal 2 disposed at an end of a fixture 1 or a diaphragm such as the casing, bypasses to the casing of the turbine, and then moves to a next inner space of the turbine through a gap A formed at a joint part between the bucket 4 and the rotor wheel 3.

However, the gap A is relatively narrow and the flow of the cooling fluid is subjected to a large resistance. The related art adjusts the gap A. In this case, as illustrated in FIG. 2, the related art mainly adjusts a position of a locking key 5 to change a size of the gap A. That is, the related art adjusts gaps between a blade 4*a* of the bucket, a platform 4*b*, and an outer circumferential surface of the rotor wheel 3. However, this increases maintenance workload of a worker since the assembly of the turbine is completed and the turbine must be disassembled to adjust the position of each locking key 5 one by one.

Further, as illustrated in FIGS. 3 and 4, constant gaps B and C are machined between a dovetail 4*c* and a dovetail mounting part 3*a* of the rotor wheel 3 in consideration of thermal expansion during operation of the turbine between the dovetail 4*c* and the dovetail mounting portion 3*a* formed along an outer circumferential surface of the rotor wheel 3.

However, the gaps B and C are for thermal expansion, but the cooling fluid flows in the gaps B and C and thus flows in an undesired direction. Since a cooling effect at the gaps B and C is relatively small, there is a need to improve the cooling structure the can induce the flow of the cooling fluid in a more preferable direction inside the turbine.

BRIEF SUMMARY

An object of the present disclosure is to provide a cooling structure capable of improving cooling of a joint part between a bucket and a rotor wheel and the rotor wheel itself.

Other objects and advantages of the present disclosure can be understood by the following description, and become apparent with reference to the embodiments of the present disclosure.

The present disclosure relates to a structure for cooling a rotor of a turbomachine and a rotor and a turbomachine having the same. In accordance with one aspect of the present disclosure, a structure for cooling a rotor of a turbomachine includes: a dovetail joint part disposed along an outer circumferential surface of a rotor wheel and having a plurality of mounting grooves in which dovetails of buckets are mounted; and cooling slots disposed along the outer circumferential surface of the rotor wheel on the dovetail joint part and having a cooling fluid flowing therethrough.

The cooling slots may be disposed with a predetermined number of mounting grooves disposed therebetween.

The cooling slot may have a rectangular cross section shape.

The cooling slot may have a trapezoidal cross section shape.

The cooling slot may have a semicircular cross section shape.

The cooling slot may further include an inclined part inclined outwardly from a central side of the outer circumferential surface of the rotor wheel.

The cooling slot may further include a stair portion having a flow area of the cooling fluid expanded stepwise outwardly from a central side of the outer circumferential surface of the rotor wheel.

The structure may further include: a guide groove disposed in a circumferential direction along an outer circumference of a lower part of the mounting groove; and a ring-shaped locking strip inserted into the guide groove, in which the locking strip may be provided to seal an interval formed between a lower end of the dovetail of the bucket and a lower end of the mounting groove.

The structure may further include: a plurality of cooling wheel holes disposed along a circumferential direction of the rotor wheel and having the cooling fluid flowing therethrough.

The cooling wheel hole may be disposed to penetrate through the rotor wheel and may be bent inside the rotor wheel.

The cooling wheel hole may be disposed to penetrate through the rotor wheel and may be curved inside the rotor wheel.

The cooling wheel hole may have a shape tapered outwardly from a central side of an inside of the rotor wheel.

The cooling wheel hole may have a stair shape in which an inflow cross sectional area of the cooling fluid is expanded stepwise outwardly from a central side of an inside of the rotor wheel.

The structure may further include: a gap portion formed in a space between the mounting groove and the dovetail of the bucket to have the cooling fluid flowing in the space between the mounting groove and the dovetail of the bucket, when the dovetail of the bucket is mounted in the mounting groove formed at the dovetail joint part.

The gap portion may include: a first gap portion formed in a space between an upper part of the mounting groove and an upper part of the dovetail of the bucket; a second gap portion formed in a space between a middle part of the mounting groove and a middle part of the dovetail of the bucket; and a third gap portion formed in a space between a lower part of the mounting groove and a lower part of the dovetail of the bucket.

Flow cross sectional areas between the first, second, and third gap portions may be different from each other.

The flow cross sectional area in which the cooling fluid flows may be gradually increased from the third gap portion toward the first gap portion.

A flow cross sectional area A1 of the cooling slot may be larger than a flow cross sectional area A2 of the gap portion.

In accordance with another aspect of the present invention, a rotor includes: a rotor wheel including the structure for cooling a turbomachine's rotor part; and a plurality of rotor shafts disposed along an outer circumferential surface of the rotor wheel.

In accordance with still another aspect of the present disclosure, a turbomachine includes: a casing; a stator that is disposed on the inner a stator disposed on an inner circumferential surface of the casing and having a plurality of vanes mounted along a circumferential direction thereof; the rotor of claim 19 disposed at a central side of an inside of the casing and having a plurality of buckets alternately disposed to the plurality of vanes.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a diagram illustrating a flow of a cooling fluid inside the existing turbine;

FIG. 2 is a diagram illustrating a locking key for adjusting a gap of a dovetail joint part between the existing bucket and a rotor wheel;

FIG. 3 is a diagram illustrating a gap between a dovetail and a dovetail joint part;

FIG. 4 is a diagram illustrating a gap between a dovetail and a dovetail joint part;

FIG. 5 is a diagram illustrating a flow of a cooling fluid of a structure for cooling a rotor of a turbomachine according to the present disclosure;

FIG. 6 is a diagram illustrating a cooling slot according to the present disclosure;

FIG. 7 is a diagram illustrating a cooling slot according to the present disclosure;

FIG. 8 is a diagram illustrating a shape of a cooling slot according to the present disclosure;

FIG. 9 is a diagram illustrating a shape of a cooling slot according to the present disclosure;

FIG. 10 is a diagram illustrating a shape of a cooling slot according to the present disclosure;

FIG. 11 is a diagram illustrating a shape of a cooling slot according to the present disclosure;

FIG. 12 is a drawing illustrating a locking strip according to the present disclosure;

FIG. 13 is a diagram illustrating a gap between a dovetail and a dovetail joint part according to the present disclosure;

FIG. 14 is a diagram illustrating an example of a cooling wheel hole according to the present disclosure;

FIG. 15 is a diagram illustrating an example of a cooling wheel hole according to the present disclosure;

FIG. 16 is a diagram illustrating an example of a cooling wheel hole according to the present disclosure;

FIG. 17 is a diagram illustrating an example of a cooling wheel hole according to the present disclosure; and FIG. 18 is a diagram illustrating a flow cross sectional area of the cooling slot and a flow cross sectional area of a gap portion according to the present disclosure.

DETAILED DESCRIPTION

Hereinafter, preferred embodiments of a structure for cooling a rotor of a turbomachine and a rotor and a turbomachine having the same will be described in detail with reference to the accompanying drawings.

FIG. 5 is a diagram illustrating a flow of a cooling fluid of a structure for cooling a rotor of a turbomachine, FIGS. 6 and 7 are diagrams illustrating a cooling slot 140, FIGS. 8 and 11 are diagrams illustrating various shapes of the cooling slot 140, FIG. 12 is a drawing illustrating a locking strip 160, and FIG. 13 is a diagram illustrating a gap between a dovetail 175 and a dovetail joint part 130.

Referring to FIGS. 5 to 13, the structure for cooling a rotor of a turbomachine according to the present disclosure may include the dovetail joint part 130 disposed along an outer circumferential surface of the rotor wheel 110 and having a plurality of mounting grooves in which the dovetails 175 of the buckets 170 are mounted, and cooling slots 140 that are disposed along the outer circumferential surface of the rotor wheel 110 on the dovetail joint part 130 through which a cooling fluid may flow therethrough.

Referring to FIG. 6, the cooling slots 140 may be disposed, with a predetermined number of plurality of mounting grooves 131, 133, and 135 disposed therebetween. For example, the cooling slots 140 may be disposed in plural in a circumferential direction, with two or three dovetail mounting grooves 131, 133, and 135 disposed therebetween.

Further, the flow of the cooling fluid flowing through an area D, that is, a platform 173 at a lower end of a blade 171 and a gap formed between the dovetail 175 and the dovetail joint part 130, may be increased in the cooling slots 140. The gap is not necessarily limited thereto, and therefore may also be changed depending on a size, a shape or the like of the rotor wheel 110.

The cooling slot 140 may be formed on both sides of the outer circumferential surface of the rotor wheel 110, or may also be disposed only on a direction side into which the cooling fluid inflows or on a direction side to which the cooling fluid outflows.

The cooling slot 140 may have a rectangular cross section shape as illustrated in FIG. 7 in an embodiment. The cooling fluid may flows in a first gap 181 through the cooling slot 140 having the rectangular cross section to increase a cooling effect between the platform 173 and the dovetail joint part 130.

Another shape of the cooling slot 140 may be provided in a semicircular cross section shape as illustrated in FIG. 8. Further, the cooling fluid flowing in the first gap 181 formed between the platform 173 of the bucket 170 and the dovetail joint part 130 may be increased, such that there is an increase in the cooling effect. In the case of the semicircular cross section shape, fatigue strength may be uniformly dispersed during machining, and when the cooling slots are disposed in the circumferential direction, the effect on the stiffness of the rotor wheel 110 is reduced.

FIG. 9 illustrates a trapezoidal cross section shape as another shape of the cooling slot 140. Compared with the rectangular cross-section shape, the upper part of the cooling slot is formed wider, such that a flow area of the cooling fluid can be secured wider, and only the upper part is machined wider, such that the effect on the reduction in the stiffness of the rotor wheel 110 is insignificant.

Further, referring to FIG. 10, the cooling slot 140 may further include a stair portion 143 having the flow area of the cooling fluid expanded stepwise outwardly from the central side of the outer circumferential surface of the rotor wheel 110.

If the cooling fluid passes through the first gap 181 and reaches the stair portion 143, the flow direction of the cooling fluid is dispersed by expanding the flow area stepwise. This expands the cooling area of the rotor wheel 110 and the platform 173 of the bucket 170. However, a step difference is preferably reduced so that the machining of the stair portion 143 reduces the effect on the stiffness of the rotor wheel 110.

In FIG. 11, another type of the cooling slot 140 is illustrated. The cooling slot 140 may further include an inclined part 141 that is inclined outwardly from the central side of the outer circumferential surface of the rotor wheel 110.

If the cooling fluid passes through the first gap 181 and then reaches the inclined part 141, the flow direction of the cooling fluid is dispersed by expanding the flow area stepwise. This may expand the cooling area of the rotor wheel 110 and the platform 173 of the bucket 170. However, an inclined angle is preferably relatively reduced so that the machining of the inclined part 141 reduces the effect on the stiffness of the rotor wheel 110.

Meanwhile, according to an embodiment of the present disclosure, a guide groove 150 disposed in a circumferential direction along an outer circumference of a lower part of the plurality of mounting grooves 131, 133 and 135, and the ring-shaped locking strip 160 inserted into the guide groove 150 may be further provided.

The locking strip 160 may serve to seal a third gap 185 (see FIG. 6) formed between the lower end of the dovetail 175 of the bucket 170 and the lower part of the mounting groove.

The third gap 185 defines a spacing between the lower end of the dovetail 175 and the lower part of the mounting groove in order to prepare for the thermal expansion of the dovetail 175 during the operation of the turbine. However, the cooling fluid flows through the third interval 185. According to an embodiment, the flow space may be blocked by the locking strip 160 so that most of the cooling fluid flows through the direction of the cooling slot 140 and the first gap 181.

The length of the locking strip 160 may be adjusted so that only a part of the third gap 185 formed along the circumferential direction of the rotor wheel 110 is closed.

Referring back to FIGS. 6 and 13, in an area E, a second gap 183 through which the cooling fluid flows may be seen. In FIG. 3, a gap such as reference numeral B is machined in consideration of a size of the thermal expansion between the dovetail 175 and the mounting groove during the operation. The cooling fluid also flows through the gap.

According to the present disclosure, the size of the second gap 183 formed between the dovetail 175 and the mounting groove 135 is reduced as illustrated in FIG. 13. However, the reduction range is preferably determined in consideration of a change in size with respect to thermal expansion.

The reduction in the second gap 183 is also to induce a main flow of the cooling fluid in the direction of the cooling slot 140.

According to the present disclosure, the flow of the cooling fluid is concentrated in the direction of the cooling slot 140 by sealing the third gap 185 with the locking strip 160 and reducing the size of the second gap 183. Since the second gap 183 and the third gap 185 are spaces for thermal expansion during the operation of the turbine, the effect of the flow of the cooling fluid on the cooling effect is insignificant. As a result, the flow of the cooling fluid is concentrated in the direction of the cooling slot 140 to increase the cooling effect of the site where cooling is desirable.

Meanwhile, according to the embodiment of the present invention, as illustrated in FIG. 5, a plurality of cooling wheel holes 120 that are disposed along the circumferential direction of the rotor wheel 110 and have the cooling fluid flowing therethrough may be further provided. The cooling fluid can further improve the cooling of the rotor wheel 110 as it flows in the radial direction of the rotor wheel 110 through the cooling wheel hole 120. The cooling wheel hole 120 may be formed in various shapes such as a circular cross section, a rectangular cross section, a trapezoidal cross section, and the like.

As described above, according to the embodiment of the present disclosure, as illustrated in FIG. 5, the cooling slot 140 and the cooling wheel hole 120 are machined on the rotor wheel 110 to induce the flow direction of the cooling fluid. That is, some of the cooling fluid passes through the cooling wheel hole 120 to cool the rotor wheel 110, while other some thereof passes through the cooling slot 140 and the first gap 181 to cool the dovetail joint part 130 and the platform 173 of the bucket 170. The cooling fluid passes through a brush seal 213 between the fixture and the rotor and passes through the cooling slot 140 and the cooling wheel hole 120 that are disposed in the next stage to continuously perform the cooling.

FIGS. 14 to 17 illustrate various embodiments of the cooling wheel hole 120.

Referring first to FIG. 14, a first shape of the cooling wheel hole 120 may be a shape in which the cooling wheel hole 120 may be a disposed to penetrate through the rotor wheel 110 and may be bent inside the rotor wheel 110.

The plurality of cooling wheel holes 120 may be disposed along the circumferential direction of the rotor wheel 110, and the plurality of the cooling wheel holes 120 may be disposed along the longitudinal direction of the rotor wheel 110 as illustrated in FIG. 14.

When the cooling wheel hole is configured in a bent shape, as illustrated in FIG. 14, the bent parts may be disposed to be opposite to each other. The bent part may be machined to face at the outer circumferential direction of the rotor wheel 110 at a site where the cooling fluid moves outwardly to smooth the inflow of the cooling fluid. On the other hand, the bent part may be machined to face at the inner circumferential direction of the rotor wheel 110 at a site where the cooling fluid moves inwardly to smooth the outflow of the cooling fluid.

By the machining of the cooling wheel hole 120 as described above, the inflow and outflow of the cooling fluid meet the general large flow of the cooling fluid.

As described above, the plurality of rotor wheels 110 are disposed with respect to the longitudinal direction and thus the cooling effect of the rotor wheel can be further increased.

Referring next to FIG. 15, a second shape of the cooling wheel hole 120 may be a shape in which the cooling wheel hole 120 may be disposed to penetrate through the rotor wheel 110 and may be a curved shape inside the rotor wheel 110.

The plurality of cooling wheel holes 120 may be disposed along the circumferential direction of the rotor wheel 110, and the plurality of the cooling wheel holes 120 may be disposed along the longitudinal direction of the rotor wheel 110 as illustrated in FIG. 15.

When the cooling wheel hole is in the curved shape, as illustrated in FIG. 15, the curved parts may be disposed to be opposite to each other. This is a design considering the flow of cooling fluid.

In other words, the curved part is machined to face the outer circumferential direction of the rotor wheel 110 at a site where the cooling fluid moves outwardly to smooth the inflow of the cooling fluid. On the contrary, the curved part is machined to look at the inner circumferential direction of the rotor wheel 110 at a site where the cooling fluid moves inwardly to smooth the outflow of the cooling fluid.

Further, like the first shape of the cooling wheel hole 120, by the machining of the cooling wheel hole 120 as described above, the inflow and outflow of the cooling fluid meet the general large flow of the cooling fluid.

As described above, the plurality of rotor wheels 110 are disposed with respect to the longitudinal direction and thus the cooling effect of the rotor wheel can be further increased.

Referring next to FIG. 16, a third shape of the cooling wheel hole 120 may be a shape in which the cooling wheel hole 120 may be disposed to penetrate through the rotor wheel 110 and may be a shape tapered outwardly from the central side of the inside of the rotor wheel 110.

In this case, when the cooling fluid flows in the cooling wheel hole 120, the inflow cross sectional area of the cooling fluid is gradually reduced, such that a velocity of the cooling fluid is increased. The cooling fluid passes through the rotor wheel 110 faster due to a fast flow velocity and the heat transfer is increased due to the increase in the cooling flow of the cooling fluid, such that the cooling power of the rotor wheel 110 hole is increased. The inflow cross sectional area of the cooling wheel hole 120 is relatively large at the inflow stage, such that the effect on the general flow of the cooling fluid is reduced.

Further, when the cooling fluid outflows, the outflow cross sectional area of the cooling wheel hole 120 is gradually increased, such that the flow velocity is slow again and the effect on the general flow of the cooling fluid is reduced.

Further, like the first shape of the cooling wheel hole 120, by the machining of the cooling wheel hole 120 as described above, the inflow and outflow of the cooling fluid meet the general large flow of the cooling fluid.

Referring next to FIG. 17, a fourth shape of the cooling wheel hole 120 may be a shape in which the cooling wheel hole 120 may be disposed to penetrate through the rotor wheel 110 and may be a stair shape in which the inflow cross sectional area of the cooling fluid is stepwise expanded outwardly from the central side of the inside of the rotor wheel 110.

In this case, when the cooling fluid flows in the cooling wheel hole 120, the inflow cross sectional area of the cooling fluid is gradually reduced, such that a velocity of the cooling fluid is increased. The cooling fluid passes through the central part of the rotor wheel 110 faster due to a fast flow velocity and the heat transfer is increased due to the increase in the cooling flow of the cooling fluid, such that the cooling power of the rotor wheel 110 hole is increased. The inflow cross sectional area of the cooling wheel hole 120 is relatively large at the inflow stage, such that the effect on the general flow of the cooling fluid is reduced.

Further, when the cooling fluid outflows, the outflow cross sectional area of the cooling wheel hole 120 is gradually increased, such that the flow velocity is slow again and the effect on the general flow of the cooling fluid is reduced.

Further, like the third shape of the cooling wheel hole 120, by the machining of the cooling wheel hole 120 as described above, the inflow and outflow of the cooling fluid meet the general large flow of the cooling fluid.

Meanwhile, referring to FIG. 18, according to the embodiment of the present disclosure, when the dovetail 175 of the bucket is mounted on the mounting groove 131 formed at the dovetail joint part 130, the gap portion 190 formed in the space between the mounting groove 131 and the dovetail 175 of the bucket may be further provided so that the cooling fluid flows in the space between the mounting groove 131 and the dovetail 175 of the bucket 175.

The gap portion 190 may include a first gap portion 191 formed in a space between the upper part of the mounting groove 131 and the upper part of the dovetail 175 of the bucket, a second gap portion 193 formed in a space between a middle part of the mounting groove 131 and a middle part of the dovetail 175 of the bucket, and a third gap portion 195 formed in a space between the lower part of the mounting groove 131 and the lower part of the dovetail 175 of the bucket.

Further, areas between the first, second, and third gap portions may be different from each other.

Here, in order to increase the cooling effect at the platform 173 of the bucket and the upper part of the dovetail 175, the flow cross sectional area through which the cooling fluid flows may be gradually increased from the third gap portion 195 toward the first gap portion 191.

That is, in the flow cross sectional area A2 with respect to the overall cooling fluid of the gap portion 190, a flow cross sectional area A21 of the first gap portion 191 is formed to be larger than a flow cross sectional area A22 of the second gap portion 193 and a flow cross sectional area A22 of the second gap portion 193 is formed to be larger than a flow cross sectional area A23 of the third gap portion 195.

As a result, the cooling fluid flows relatively more in the first gap portion 191, which increases the cooling effect on the dovetail 175 of the bucket and the outer circumferential surface of the mounting groove 131.

Further, according to the embodiment of the present disclosure, the flow cross sectional area A1 of the cooling slot 140 may be larger than the flow cross sectional area A2 of the gap portion 190. This increases the cooling effect in the space between the dovetail 175 of the bucket and the dovetail joint part 130. The flow cross sectional area A1 of the cooling slot 140 is formed to be larger, such that a relatively larger amount of cooling fluid passes through the flow cross sectional area A1 of the cooling slot 140 than the flow cross sectional area A2 of the gap portion 190.

The total flow cross sectional area A2 of the gap portion 190 is formed to be larger than the flow cross sectional area A1 of the cooling slot 140 in accordance with the design direction of the cooling site, and thus it can also be considered to increase the cooling effect in the space between the dovetail 175 of the bucket 175 and the mounting groove 131.

Meanwhile, the rotor (turbomachine's rotor part) of the present disclosure may include the rotor wheel 110 including the structure for cooling a turbomachine's rotor part 100 and the plurality of rotor shafts disposed along the outer circumferential surface of the rotor wheel 110.

Further, the turbomachine according to the present disclosure includes a casing, a stator that is disposed on the inner circumferential surface of the casing and having a plurality of vanes mounted along the circumferential direction thereof, and the rotor disposed at the central side of the inside of the casing and having the plurality of buckets 170 alternately disposed to the plurality of vanes. The casing and the stator may be referred to as a fixture 210.

The above matters are only a specific embodiment of the structure for cooling a rotor of a turbomachine.

According to the present disclosure, the groove is machined at the dovetail joint part between the bucket and the rotor wheel and the locking strip is disposed to induce the flow of the cooling fluid, thereby improving the cooling effect at the joint part.

Further, the rotor wheel itself is provided with the hole through which the cooling fluid flows to induce the flow of the cooling fluid, such that the rotor wheel itself can also be cooled.

In addition, the flow cross sectional area of the cooling slot becomes larger than that of the gap portion to relatively increase the flow of the cooling fluid at the dovetail of the bucket and at the upper part of the mounting groove, thereby increasing the cooling effect of the dovetail of the bucket.

Hereinabove, preferred exemplary embodiments of the present disclosure are described for illustrative purpose, and the scope of the present disclosure is not limited to the above described specific exemplary embodiment. It will be apparent to those skilled in the art that various variations and modifications may be made without departing from the spirit and scope of the disclosure as defined in the following claims.

What is claimed is:

1. A rotor of a turbomachine, comprising:

a rotor wheel having an upstream side and a downstream side based on a flow direction of cooling fluid;

a dovetail joint part including an outer circumferential surface of the rotor wheel and a mounting groove formed in the outer circumferential surface of the rotor wheel and configured to receive a dovetail of a bucket, the outer circumferential surface configured to receive a platform of the bucket;

a gap portion formed by the outer circumferential surface of the rotor wheel and the platform of the bucket and configured to pass the cooling fluid from the upstream side of the rotor wheel and the downstream side of the rotor wheel, the gap portion having opposite ends respectively communicating with the upstream and downstream sides of the rotor wheel; and a cooling slot formed in the outer circumferential surface of the rotor wheel at at least one of the upstream and downstream sides of the rotor wheel, the cooling slot communicating with the gap portion and having first and second ends separated from each other in a longitudinal direction of the gap portion, the first end communicating with the at least one of the upstream and downstream sides of the rotor wheel and the second end communicating with the gap portion between the upstream and downstream sides of the rotor wheel.

2. The rotor of claim 1, wherein the mounting groove of the dovetail joint part consists of a plurality of mounting grooves disposed at intervals around the outer circumferential surface of the rotor wheel, and wherein the cooling slot consists of a plurality of cooling slots disposed at intervals around the outer circumferential surface of the rotor wheel, the plurality of cooling slots including an adjacent pair of cooling slots between which a number of the mounting grooves are disposed.

3. The rotor of claim 1, wherein the gap portion includes a main section disposed between the opposite ends of the gap portion, the middle section of the gap portion being narrower than the end of the gap portion communicating with the first end of the cooling slot, and wherein the second end of the cooling slot communicates with the main section of the gap portion.

4. The rotor of claim 1, wherein the first end of the cooling slot has a radial height greater than the second end of the cooling slot.

5. The rotor of claim 4, wherein the cooling slot includes a radially inward side extending from the first end of the cooling slot to the second end of the cooling slot, the radially inward side facing the gap portion.

6. The rotor of claim 5, wherein the cooling slot has a cross section extending from the first end of the cooling slot to the second end of the cooling slot, the cross section having a predetermined shape for introducing the cooling fluid into the gap portion from the first end of the cooling slot.

7. The rotor of claim 6, wherein the predetermined shape is rectangular, and the radially inward side includes a right angle disposed at the second end of the cooling slot.

8. The rotor of claim 6, wherein the predetermined shape is triangular, and the radially inward side includes a stepped surface extending from the first end of the cooling slot to the second end of the cooling slot, the stepped surface configured to expand the cooling fluid stepwise from the first end of the cooling slot to the second end of the cooling slot.

9. The rotor of claim 6, wherein the predetermined shape is triangular, and the radially inward side includes an inclined surface extending from the first end of the cooling slot to the second end of the cooling slot.

* * * * *